US009112291B2

(12) United States Patent
Kato et al.

(10) Patent No.: US 9,112,291 B2
(45) Date of Patent: Aug. 18, 2015

(54) TERMINAL CONTACT POINT STRUCTURE AND TERMINAL HAVING THE SAME

(71) Applicant: Yazaki Corporation, Tokyo (JP)

(72) Inventors: Hajime Kato, Kakegawa (JP); Shuhei Ando, Kakegawa (JP); Terumichi Matsumoto, Kakegawa (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/103,108

(22) Filed: Dec. 11, 2013

(65) Prior Publication Data

US 2014/0099842 A1 Apr. 10, 2014

Related U.S. Application Data

(63) Continuation of application No. PCT/JP2012/003771, filed on Jun. 8, 2012.

(30) Foreign Application Priority Data

Jun. 21, 2011 (JP) ..... 2011-137036

(51) Int. Cl.
*H01R 13/187* (2006.01)
*H01R 13/02* (2006.01)

(52) U.S. Cl.
CPC ..... *H01R 13/02* (2013.01); *H01R 13/187* (2013.01)

(58) Field of Classification Search
CPC . H01R 13/187; H01R 13/111; H01R 23/7068
USPC ..... 439/843, 924.1
See application file for complete search history.

(56) References Cited

U.S. PATENT DOCUMENTS 4,080,033 A * 3/1978 Deal ..... 439/816
4,083,622 A * 4/1978 Neidecker ..... 439/86
4,550,972 A * 11/1985 Romak ..... 439/839
4,753,616 A * 6/1988 Molitor ..... 439/787

(Continued)

FOREIGN PATENT DOCUMENTS

CN 101322288 A 12/2008
JP 2007-250362 9/2007

(Continued)

OTHER PUBLICATIONS

English-language translation of International Search Report from the Japanese Patent Office in PCT/JP2012/003771 mailed Jun. 8, 2012.

(Continued)

*Primary Examiner* — Gary Paumen
(74) *Attorney, Agent, or Firm* — Sughrue Mion, PLLC

(57) ABSTRACT

A terminal contact point structure includes: an insertion portion for a conduction portion of a counterpart terminal to be inserted; and contact portions disposed at the insertion portion and configured to contact the conduction portion of the counterpart terminal. The contact portions are disposed in a plurality of rows in a direction perpendicular to an insertion direction of the conduction portion of the counterpart terminal to form a contact group. The contact portions in the contact group are positioned displaced to each other backward-forward in the insertion direction to contact, at different timings respectively, the conduction portion of the counterpart terminal being inserted.

7 Claims, 3 Drawing Sheets

(56) References Cited

U.S. PATENT DOCUMENTS

| | | | | |
|---|---|---|---|---|
| 5,261,840 | A * | 11/1993 | Benz | 439/843 |
| 5,667,413 | A | 9/1997 | Trafton | |
| 6,062,919 | A * | 5/2000 | Trafton | 439/843 |
| 6,186,840 | B1 * | 2/2001 | Geltsch et al. | 439/843 |
| 2005/0287877 | A1 | 12/2005 | Fukuda et al. | |
| 2007/0218736 | A1 | 9/2007 | Takizawa et al. | |
| 2009/0029605 | A1 | 1/2009 | Matsumoto et al. | |

FOREIGN PATENT DOCUMENTS

| | | | |
|---|---|---|---|
| JP | 201144256 | A | 3/2011 |
| JP | 2012252974 | A | 12/2012 |
| WO | 2011001821 | A1 | 1/2011 |
| WO | WO 2011/059191 | A1 | 5/2011 |

OTHER PUBLICATIONS

Communication dated Jan. 20, 2015 from the Japanese Patent Office in counterpart application No. 2011-137036.

Communication dated May 20, 2015, issued by the State Intellectual Property Office of the People's Republic of China in corresponding Chinese Application No. 201280028323.0.

* cited by examiner

TERMINAL CONTACT POINT STRUCTURE AND TERMINAL HAVING THE SAME

CROSS REFERENCE TO RELATED APPLICATION

This application is a Continuation of PCT Application No. PCT/JP2012/003771, filed on Jun. 8, 2012 , and claims the priority of Japanese Patent Application No. 2011-137036 , filed on Jun. 21, 2011 , the content of both of which is incorporated herein by reference.

BACKGROUND

1. Technical Field

The present invention relates to a terminal contact point structure and a terminal having the same.

2. Related Art

Japanese Unexamined Patent Application Publication No. 2007-250362 describes a terminal contact point structure where a plurality of contact points which contact a counterpart terminal are provided. This terminal contact point structure has a frame member serving as an insertion portion to which a plate-like terminal serving as a conduction portion of the counterpart terminal is inserted and a rotation member disposed at the frame member and serving as a plurality of contact portions which contact the plate-like terminal of the counterpart terminal.

In this terminal contact point structure, the rotation member is twisted relative to the frame member and thereby is biased toward the plate-like terminal. Therefore, changing a width of the connection between the frame member and the rotation member can adjust the biasing force of the rotation member toward the plate-like terminal.

SUMMARY

However, in the terminal contact point structure above, a plurality of contact portions such as the rotation members are disposed in one row to an insertion direction of the conduction portion of the counterpart terminal, and therefore, the position of the contact point position between the conduction portion and the contact portion is concentrated on one point in the insertion direction. This greatly increases the maximum insertion force of the counterpart terminal.

It is an object of the present invention to provide a terminal contact point structure and a terminal having the same which are capable of decreasing a maximum insertion force of a counterpart terminal.

A first aspect of the present invention is a terminal contact point structure including: an insertion portion for a conduction portion of a counterpart terminal to be inserted; and contact portions disposed at the insertion portion and configured to contact the conduction portion of the counterpart terminal, wherein the contact portions are disposed in a plurality of rows in a direction perpendicular to an insertion direction of the conduction portion of the counterpart terminal to form a contact group, and wherein the contact portions in the contact group are positioned displaced to each other backward-forward in the insertion direction to contact, at different timings respectively, the conduction portion of the counterpart terminal being inserted.

According to the first aspect, the contact portions are disposed in a plurality of rows in the direction perpendicular to the insertion direction of the conduction portion of the counterpart terminal, to thereby form a contact group. The contact portions of the contact group are disposed and positioned in such a configuration as to be displaced to each other backward-forward in the insertion direction, and are so made as to contact, at different timings respectively, the conduction portion of the counterpart terminal to be inserted. With this configuration, the contact point position where the conduction portion of the counterpart terminal contacts the contact portions can be distributed in the insertion direction over the direction perpendicular to the insertion direction, thus making it possible to decrease the maximum insertion force of the counterpart terminal.

Since there are a plurality of contact point positions where the conduction portion of the counterpart terminal contacts the contact portions, conduction with the counterpart terminal can be securely kept while the maximum insertion force of the counterpart terminal is decreased.

The terminal contact point structure may include contact groups disposed in a plurality of rows in the insertion direction.

According to the above structure, the terminal contact point structure includes contact groups each of which decreases the maximum insertion force of the counterpart terminal and which are disposed in a plurality of rows in the insertion direction. Thus, the contact point position where the conduction portion of the counterpart terminal contacts the contact groups can be distributed in the insertion direction, thus making it possible to further decrease the maximum insertion force of the counterpart terminal.

The contact portions may be scattered in a direction intersecting with the insertion direction.

According to the above structure, the contact portions are scattered in the direction intersecting with the insertion direction of the conduction portion of the counterpart terminal. Thus, the location for disposing the contact portions in the insertion portion can be effectively selected in view of the maximum insertion force of the counterpart terminal as well as conduction with the counterpart terminal.

A second aspect of the present invention is a terminal including: the terminal contact point structure above; a mating portion to be mated with the counterpart terminal; and a connection portion integrated with the mating portion and connected to an electric wire, wherein the insertion portion is disposed at the mating portion.

According to the second aspect, the terminal has the terminal contact point structure which can decrease the maximum insertion force of the counterpart terminal. Thus, it becomes possible to mate the above terminal with the counterpart terminal easily, and it becomes possible to prevent inadequate mating of the above terminal with the counterpart terminal.

According to the embodiments of the present invention, it is possible to provide a terminal contact point structure and a terminal having the same which are capable of decreasing a maximum insertion force of a counterpart terminal.

DETAILED DESCRIPTION

By referring to FIG. 1 to FIG. 5, a terminal contact point structure according to embodiments of the present invention will be explained.

[First Embodiment]

Figure 1:
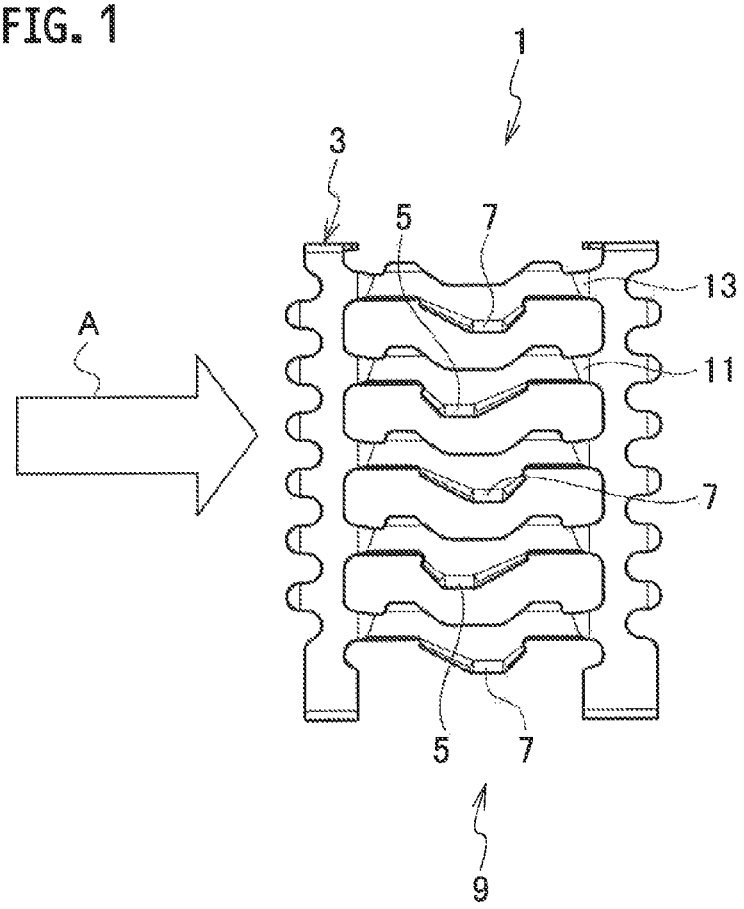
FIG. 1 is a front view of a terminal contact point structure according to a first embodiment of the present invention.
Figure 2:
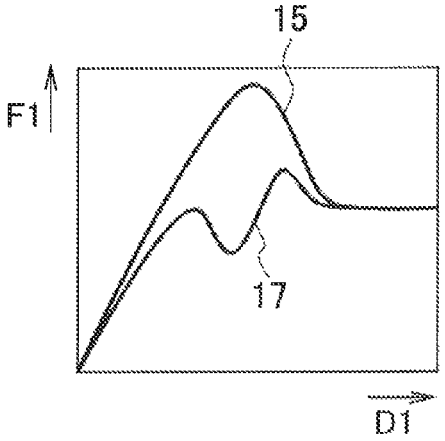
FIG. 2 is a diagram showing a relationship between an insertion distance and an insertion force of a counterpart terminal to an insertion portion of the terminal contact point structure according to the first embodiment of the present invention.

By referring to FIG. 1 and FIG. 2, a first embodiment will be set forth.

As shown in FIG. 1, a terminal contact point structure 1 according to the first embodiment includes an insertion portion 3 to which a conduction portion (not shown) of a counterpart terminal is inserted and contact portions 5, 7 which are disposed at the insertion portion 3 and configured to contact the conduction portion of the counterpart terminal.

The contact portions 5, 7 are disposed in a plurality of rows (five rows according to the first embodiment) in a direction perpendicular to an insertion direction of the conduction portion of the counterpart terminal (the direction of the arrow A in FIG. 1, hereinafter, simply referred to as the insertion direction), to thereby form a contact group 9. The contact portions 5 and the contact portions 7 of the contact group 9 are disposed and positioned in such a configuration as to be displaced to each other backward-forward in the insertion direction.

Though not shown herein, a terminal according to the embodiment of the present invention has a mating portion configured to be mated with the counterpart terminal, and a connection portion integrated with the mating portion and connected to an electric wire. The terminal is a female terminal where the mating portion is formed tubular. The terminal contact point structure 1 is disposed in the above mating portion.

The insertion portion 3 is made of a conductive material and formed into a thin plate. The insertion portion 3 is disposed in the mating portion of the terminal, and the conduction portion of a male terminal as the counterpart terminal is inserted into the insertion portion 3 from the direction shown by the arrow A. The conduction portion of the counterpart terminal is of a round pin-type, a tab-type or the like. The insertion portion 3 is molded in accordance with the configuration of the conduction portion of the counterpart terminal. The contact portions 5, 7 are provided within the insertion portion 3.

The contact portions 5 and the contact portions 7 are integrally connected with the insertion portion 3 via connections 11, 13 respectively, thus the contact portions 5, 7 and the insertion portion 3 form a single member. With the connections 11, 13 twisted at a predetermined torsional angle, the contact portions 5, 7 elastically deformably contact the conduction portion of the counterpart terminal and are conducted therewith.

The contact portions 5 and the contact portions 7 are disposed and positioned in such a configuration as to be displaced to each other backward-forward in the insertion direction, and are so made as to contact, at different timings, the conduction portion of the counterpart terminal to be inserted. To be specific, three contact portions 7 are disposed on the front end side (the right side in FIG. 1) of the insertion direction of the conduction portion of the counterpart terminal and two contact portions 5 are disposed on the rear end side (the left side in FIG. 1) of the insertion direction.

In FIG. 2, D1 denotes an insertion distance of the counterpart terminal in the insertion portion 3 of the terminal contact point structure 1 according to the first embodiment and F1 denotes an insertion force of the counterpart terminal. The terminal contact point structure 1 having the above configuration accomplishes that the maximum insertion force (one maximum peak) of an insertion three line 15 by the plurality of contact points disposed in one row in the direction perpendicular to the insertion direction in the contact group 9 can be distributed into two insertion forces (two peaks) as denoted by an insertion force line 17. Thus, the maximum insertion three of the conduction portion of the counterpart terminal into the insertion portion 3 can be decreased, making it possible to accomplish an easy mating between the terminals and to accomplish a secure conduction between the counterpart terminal and the terminal of the first embodiment. In addition, with the related terminal contact point structure, since the maximum insertion force of the conduction portion of the counterpart terminal to the insertion portion 3 was high, an operator was more susceptible to injury to his/her hand, whereas with the terminal contact point structure 1 according to the first embodiment, the maximum insertion force of the counterpart terminal is decreased, thereby making it possible to prevent the operator from injuring his/her hand.

In the terminal contact point structure 1, the contact portions 5, 7 are disposed in a plurality of rows in the direction perpendicular to the insertion direction of the conduction portion of the counterpart terminal, to thereby form the contact group 9. The contact portions 5 and the contact portions 7 of the contact group 9 are disposed and positioned in such a configuration as to be displaced to each other backward-forward in the insertion direction, and are so made as to contact, at different timings, the conduction portion of the counterpart terminal to be inserted. Thus, the contact point position where the conduction portion of the counterpart terminal contacts the contact portions 5 and the contact portions 7 can be distributed in the insertion direction over the direction perpendicular to the insertion direction, thus making it possible to decrease the maximum insertion force of the counterpart terminal.

Since there are a plurality of contact point positions where the conduction portion of the counterpart terminal contacts the contact portions 5, 7, the conduction with the counterpart terminal can be securely kept while the maximum insertion force of the counterpart terminal is decreased.

[Second Embodiment]

Figure 3:
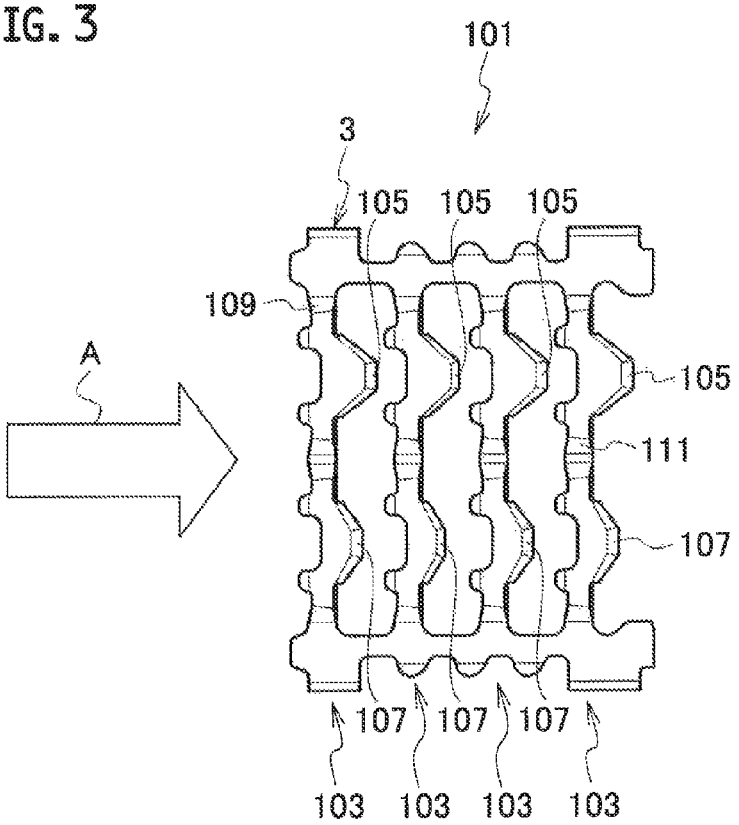
FIG. 3 is a front view of a terminal contact point structure according to a second embodiment of the present invention.
Figure 4:
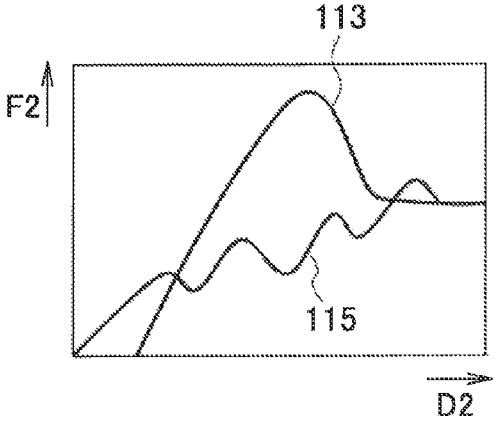
FIG. 4 is a diagram showing a relationship between an insertion distance and an insertion force of a counterpart terminal to an insertion portion of the terminal contact point structure according to the second embodiment of the present invention.
Figure 5:
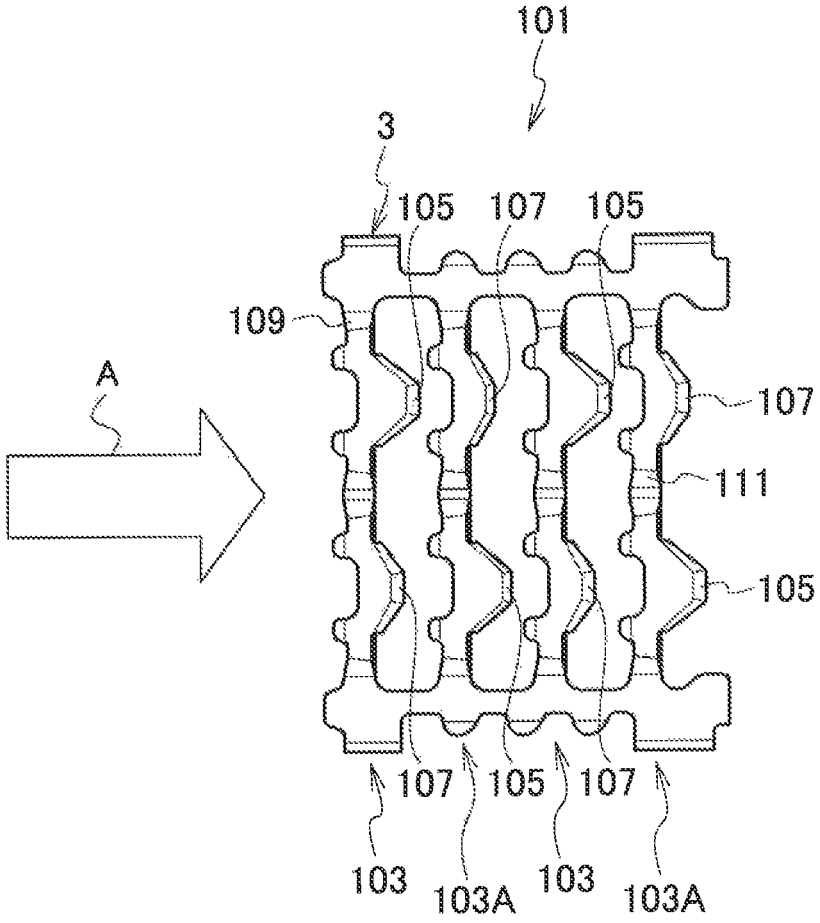
FIG. 5 is a front view showing another example of the terminal contact point structure according to the second embodiment of the present invention.

By referring to FIG. 3 to FIG. 5, a second embodiment will be set forth.

In a terminal contact point structure 101 according to the second embodiment, contact groups 103 are disposed in a plurality of rows in the insertion direction (the direction of the arrow A in FIG. 3, hereinafter, simply referred to as the insertion direction).

Contact portions 105, 107 are scattered in a direction intersecting with the insertion direction. Structures that are the same as those according to the first embodiment will be denoted by the same reference signs or numerals referring to the first embodiment and therefore explanations of the same structures will be omitted. The structures of the second embodiment that are the same as those of the first embodiment have the effects that are same as those of the first embodiment.

As shown in FIG. 3, the contact portions 105, 107 are disposed in a plurality of rows (herein, two rows) in a direction perpendicular to the insertion direction of the conduction portion of the counterpart terminal, to thereby form the contact group 103. The contact portion 105 and the contact portion 107 of each contact group 103 are integrally connected with the insertion portion 3 via connections 109 respectively and the adjacent contact portions 105, 107 of each contact group 103 are connected with each other via a connection 111, thus the contact portions 105, 107 of each contact group 103 and the insertion portion 3 form a single member. With the connections 109, 111 twisted at a predetermined torsional angle, the contact portions 105, 107 elastically deformably contact the conduction portion of the counterpart terminal and are conducted therewith.

The contact groups 103 each having the contact portions 105, 107 are disposed in a plurality of rows (herein, four rows) in the insertion direction of the counterpart terminal. Thus, in the insertion direction of the counterpart terminal, there are a plurality of contact locations (herein, eight locations) where the contact portions 105, 107 of the contact groups 103 contact the conduction portion of the counterpart terminal.

The present invention is not limited to a configuration in which the contact groups 103 having the same structure are disposed in a plurality of rows in the insertion direction. For example, as shown in FIG. 5, the contact portions 105, 107 in the adjacent contact groups 103, 103A may be disposed such that the contact portions 105, 107 have zigzag alignment displaced backward-forward. In this way, scattering the contact portions 105 and the contact portions 107 in the direction intersecting with the insertion direction (the arrow A in FIG. A) can optimize distribution of the maximum insertion force of the counterpart terminal as well as conduction with the counterpart terminal.

In FIG. 4, D2 denotes an insertion distance of the counterpart terminal into the insertion portion 3 of the terminal contact point structure 101 according to the second embodiment and F2 denotes an insertion force of the counterpart terminal. The terminal contact point structure 101 having the above configuration accomplishes that the maximum insertion force (one maximum peak) of an insertion force line 113 by the plurality of contact portions disposed in one row in the direction perpendicular to the insertion direction in the contact group 103 can be distributed, by the four contact groups 103, into four insertion forces (four peaks) as denoted by an insertion force line 115. Further, the one contact group 103 can have the one maximum peak to be distributed into two peaks. Thus, the terminal contact point structure 101 can have the maximum insertion force of the counterpart terminal into eight insertion forces, thus making it possible to further decrease the maximum insertion force (of the conduction portion of the counterpart terminal) to the insertion portion 3.

With the terminal contact point structure 101, the contact groups 103 each of which decreases the maximum insertion force of the counterpart terminal are disposed in a plurality of rows in the insertion direction. Thus, the contact point position where the conduction portion of the counterpart terminal contacts the plurality of contact groups 103 can be distributed in the insertion direction, thus making it possible to further decrease the maximum insertion force of the counterpart terminal.

The contact portions 105 and the contact portions 107 are scattered in the direction intersecting with the insertion direction of the conduction portion of the counterpart terminal. Thus, the location for disposing the contact portions 105, 107 in the insertion portion 3 can be effectively selected in view of the maximum insertion force of the counterpart terminal as well as conduction with the counterpart terminal.

The terminal having any of the terminal contact point structures 1, 101 can decrease the maximum insertion force of the counterpart terminal by means of the terminal contact point structures 1, 101. Thus, it becomes possible to mate the above terminal with the counterpart terminal easily and it becomes possible to prevent inadequate mating of the above terminal with the counterpart terminal.

With the terminal having any of the terminal contact point structures 1, 101 according to the respective first and second embodiments of the present invention, the insertion portion 3 to be disposed in the mating portion of the female terminal is provided with the contact portions 5, 7, 105, 107. However, it is possible to dispose the insertion portion 3 on another mating portion such as a male terminal tab; to provide contact groups 9, 103, 103A by disposing, to the insertion portion 3, the contact portions 5, 7, 105, 107 in a plurality of rows in the direction perpendicular to the insertion direction of the conduction portion of the counterpart terminal (female terminal); and to displace the contact portions 5, 7, 105, 107 in the contact groups 9, 103, 103A to each other backward-forward in the insertion direction.

In the terminal contact point structure 1 according to the first embodiment, the contact portions 5, 7 of the contact group 9 are disposed in the insertion direction, specifically, three contact portions on the front end side and two contact portions on the rear end side. However, the present invention is not limited to this configuration. All contact portions 5, 7 may be disposed at different positions in the insertion direction.

Although the present invention has been described above by reference to the embodiments, the present invention is not limited to those and the configuration of parts can be replaced with any configuration having a similar function.

What is claimed is:

1. A terminal contact point structure comprising:

an insertion portion for a conduction portion of a counterpart terminal to be inserted; and contact portions disposed at the insertion portion and configured to contact the conduction portion of the counterpart terminal, wherein the contact portions are disposed in a plurality of rows in a direction perpendicular to an insertion direction of the conduction portion of the counterpart terminal to form a contact group, wherein the contact portions in the contact group are positioned displaced to each other backward-forward in the insertion direction to contact, at different timings respectively, the conduction portion of the counterpart terminal being inserted, and wherein the terminal contact point structure comprises contact groups disposed in a plurality of rows in the insertion direction.

2. The terminal contact point structure according to claim 1, wherein the contact portions are scattered in a direction intersecting with the insertion direction.

3. The terminal contact point structure according to claim 1, wherein the insertion portion has a shape of a thin plate, and the contact portions are integrally connected with the insertion portion via connections twisted at a predetermined torsional angle.

4. The terminal contact point structure according to claim 3, wherein all of the contact portions are twisted in a same direction.

5. A terminal comprising:

a terminal contact point structure including an insertion portion for a conduction portion of a counterpart terminal to be inserted, and contact portions disposed at the insertion portion and configured to contact the conduction portion of the counterpart terminal, wherein the contact portions are disposed in a plurality of rows in a direction perpendicular to an insertion direction of the conduction portion of the counterpart terminal to form a contact group, wherein the contact portions in the contact group are positioned displaced to each other backward-forward in the insertion direction to contact, at different timings respectively, the conduction portion of the counterpart terminal being inserted, and wherein the terminal contact point structure comprises contact groups disposed in a plurality of rows in the insertion direction;

a mating portion to be mated with the counterpart terminal; and a connection portion integrated with the mating portion and connected to an electric wire, wherein the insertion portion is disposed at the mating portion.

6. The terminal contact point structure according to claim 1, wherein the contact portions are in an alignment with each other in the direction perpendicular to the insertion direction, at least one contact portion in the alignment is disposed on a front end side of the insertion direction which is positioned towards the insertion portion, and at least one contact portion in the alignment is disposed on a rear end side of he insertion direction which is positioned away from the insertion portion.

7. The terminal contact point structure according to claim 5, wherein the contact portions are in an alignment with each other in the direction perpendicular to the insertion direction, at least one contact portion in the alignment is disposed on a front end side of the insertion direction which is positioned towards the insertion portion, and at least one contact portion in the alignment is disposed on a rear end side of he insertion direction which is positioned away from the insertion portion.

* * * * *